US011087677B2

(12) United States Patent
Wu et al.

(10) Patent No.: US 11,087,677 B2
(45) Date of Patent: Aug. 10, 2021

(54) ELECTRONIC DEVICE AND AMBIENT LIGHT SENSING METHOD THEREOF

(71) Applicant: EMINENT ELECTRONIC TECHNOLOGY CORP. LTD., Hsin-Chu (TW)

(72) Inventors: Kao-Pin Wu, New Taipei (TW); Chan-Peng Lo, Taichung (TW)

(73) Assignee: EMINENT ELECTRONIC TECHNOLOGY CORP. LTD., Hsin-Chu (TW)

( * ) Notice: Subject to any disclaimer, the term of this patent is extended or adjusted under 35 U.S.C. 154(b) by 0 days.

(21) Appl. No.: 17/011,550

(22) Filed: Sep. 3, 2020

(65) Prior Publication Data

US 2021/0074208 A1 Mar. 11, 2021

Related U.S. Application Data

(60) Provisional application No. 62/899,144, filed on Sep. 11, 2019.

(30) Foreign Application Priority Data

May 28, 2020 (TW) ..... 109117756

(51) Int. Cl.
*G09G 3/3225* (2016.01)

(52) U.S. Cl.
CPC ... *G09G 3/3225* (2013.01); *G09G 2320/0626* (2013.01); *G09G 2360/144* (2013.01)

(58) Field of Classification Search
CPC ..... G09G 3/3225; G09G 2320/0626; G09G 2360/144; G09G 3/3208; G09G 5/10
See application file for complete search history.

(56) References Cited

U.S. PATENT DOCUMENTS 10,102,789 B2 10/2018 Evans
2016/0097962 A1 4/2016 Kim
(Continued)

FOREIGN PATENT DOCUMENTS

CN 101685593 A 3/2010
CN 103280181 A 9/2013
(Continued)

OTHER PUBLICATIONS

Office Action corresponding to Chinese application No. 202010488516.0 dated Mar. 17, 2021. (pp. 6).
(Continued)

*Primary Examiner* — Koosha Sharifi-Tafreshi
(74) *Attorney, Agent, or Firm* — Muncy, Geissler, Olds & Lowe, P.C.

(57) ABSTRACT

An electronic device includes: a OLED display including a first display area, wherein a saturation of the first display area remains constant in a first period; a display driver for driving the OLED display and changing a brightness coefficient of the first display area from a first brightness coefficient to a second brightness coefficient during the first period; an ambient light sensor under the first display area for sensing light, wherein during the first period, the ambient light sensor generates a first sensing value when the brightness coefficient of the first display area is the first brightness coefficient and generates a second sensing value when the brightness coefficient of the first display area is the second brightness coefficient; and a controller for calculating an ambient light intensity according to the first brightness coefficient, the second brightness coefficient, the first sensing value and the second sensing value.

10 Claims, 4 Drawing Sheets

(56) References Cited

U.S. PATENT DOCUMENTS

| | | | | |
|---|---|---|---|---|
| 2017/0092228 | A1* | 3/2017 | Cote | G09G 3/3225 |
| 2019/0155501 | A1* | 5/2019 | Zhang | G06F 3/04847 |
| 2019/0228204 | A1 | 7/2019 | Park | |

FOREIGN PATENT DOCUMENTS

| | | | |
|---|---|---|---|
| CN | 105592278 | A | 5/2016 |
| CN | 105841807 | A | 8/2016 |
| CN | 107818753 | A | 3/2018 |
| CN | 107945683 | A | 4/2018 |
| CN | 107957293 | A | 4/2018 |
| CN | 108986724 | A | 12/2018 |
| CN | 109238460 | A | 1/2019 |
| TW | 201917717 | A | 5/2019 |

OTHER PUBLICATIONS

Office Action and Search Report corresponding to Taiwanese Application No. 109117756 dated Jan. 20, 2021. (pp. 5).

* cited by examiner

ELECTRONIC DEVICE AND AMBIENT LIGHT SENSING METHOD THEREOF

This application claims priority for the U.S. provisional patent application No. 62/899,144 filed on 11 Sep. 2019, and Taiwan (R.O.C.) patent application no. 109117756 filed on 28 May 2020, the content of which is incorporated by reference in its entirely.

BACKGROUND OF THE INVENTION

Field of the Invention

The present invention relates to an electronic device, particularly to an electronic device with an OLED (Organic Light-Emitting Diode) display and an ambient light sensing method thereof.

Description of the Related Art

A mobile electronic device or a wearable electronic device, which is equipped with a display, is likely to use an ambient light sensor to sense an ambient light, whereby to adjust screen brightness. The present ambient light sensor is disposed in the perimeter of the screen. However, the screen-to-body ratio is growing higher and higher. Hence, the space around the screen, which is available for an ambient light sensor, becomes smaller and smaller. Arranging the ambient light sensor below the screen may be a solution to meet the requirement of high screen-to-body ratio. FIG. 1 shows a mobile phone 10, and FIG. 2 shows the sectional view taken along line AA' in FIG. 1. As shown in FIG. 1 and FIG. 2, an ambient light sensor 14 is disposed under a display 12 of the mobile phone 10. The architecture shown in FIG. 1 and FIG. 2 still has some problems to overcome. The first problem is that the ambient light AL must pass through the display 12 such that the ambient light AL can be detected by the ambient light sensor 14. The second problem is that the light DL emitted by the display 12 affects the detection of the ambient light sensor 14.

SUMMARY OF THE INVENTION

One objective of the preset invention is to provide an electronic device with an OLED display and an ambient light sensing method thereof.

In one embodiment, the present invention provides an electronic device, which comprises an OLED display including a first display area, wherein a saturation of the first display area remains constant in a first period; a display driver coupled to the OLED display, wherein the display driver changes a brightness coefficient of the first display area from a first brightness coefficient to a second brightness coefficient during the first period; an ambient light sensor under the first display area for sensing light, wherein during the first period, the ambient light sensor senses light to generate a first sensing value when the brightness coefficient of the first display area is the first brightness coefficient and the ambient light sensor senses light to generate a second sensing value when the brightness coefficient of the first display area is the second brightness coefficient; and a controller for calculating an ambient light intensity according to the first brightness coefficient, the second brightness coefficient, the first sensing value and the second sensing value.

In one embodiment, the present invention provides an ambient light sensing method of an electronic device with an OLED display, wherein the electronic device includes an ambient light sensor under a first display area of the OLED display. The ambient light sensing method comprises step A: sensing light to generate a first sensing value by the ambient light sensor when the brightness coefficient of the first display area is a first brightness coefficient in a first period; step B: sensing light to generate a second sensing value by the ambient light sensor when the brightness coefficient of the first display area is a second brightness coefficient in the first period; and step C: calculating an ambient light intensity according to the first brightness coefficient, the second brightness coefficient, the first sensing value and the second sensing value, wherein the a saturation of the first display area remains constant in the first period.

The electronic device and the ambient light sensing method of the present invention can correctly sense ambient light without being affected by the light emitted from the OLED display.

DETAILED DESCRIPTION OF THE INVENTION

Figure 2:
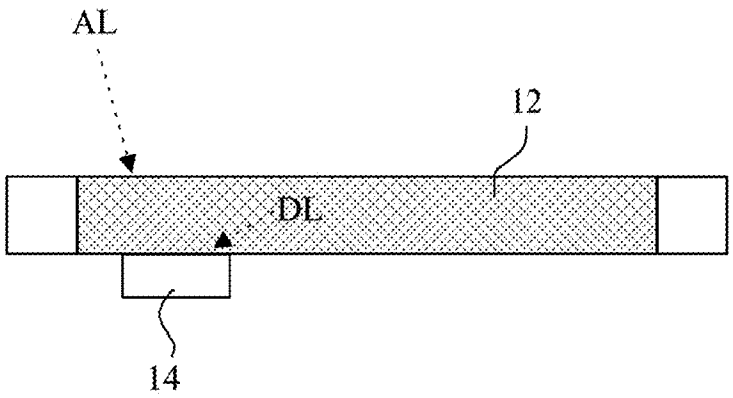
Fig. 2 Prior Art
FIG. 2 shows a sectional view of the mobile phone shown in FIG. 1.
Figure 1:
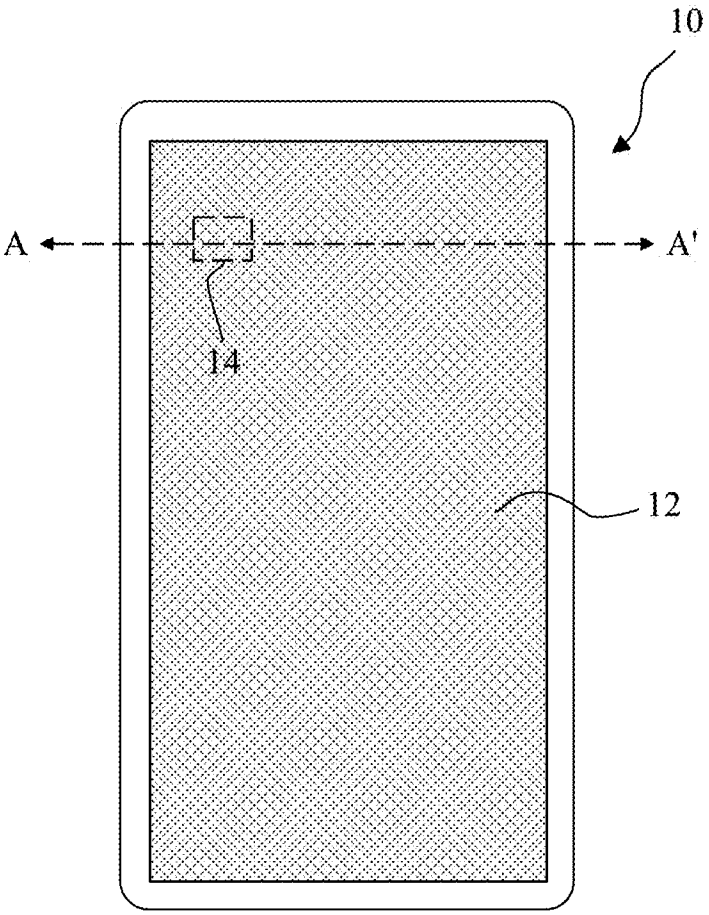
Fig. 1 Prior Art
FIG. 1 shows a mobile phone having an ambient light sensor under a display of the mobile phone.
Figure 3:
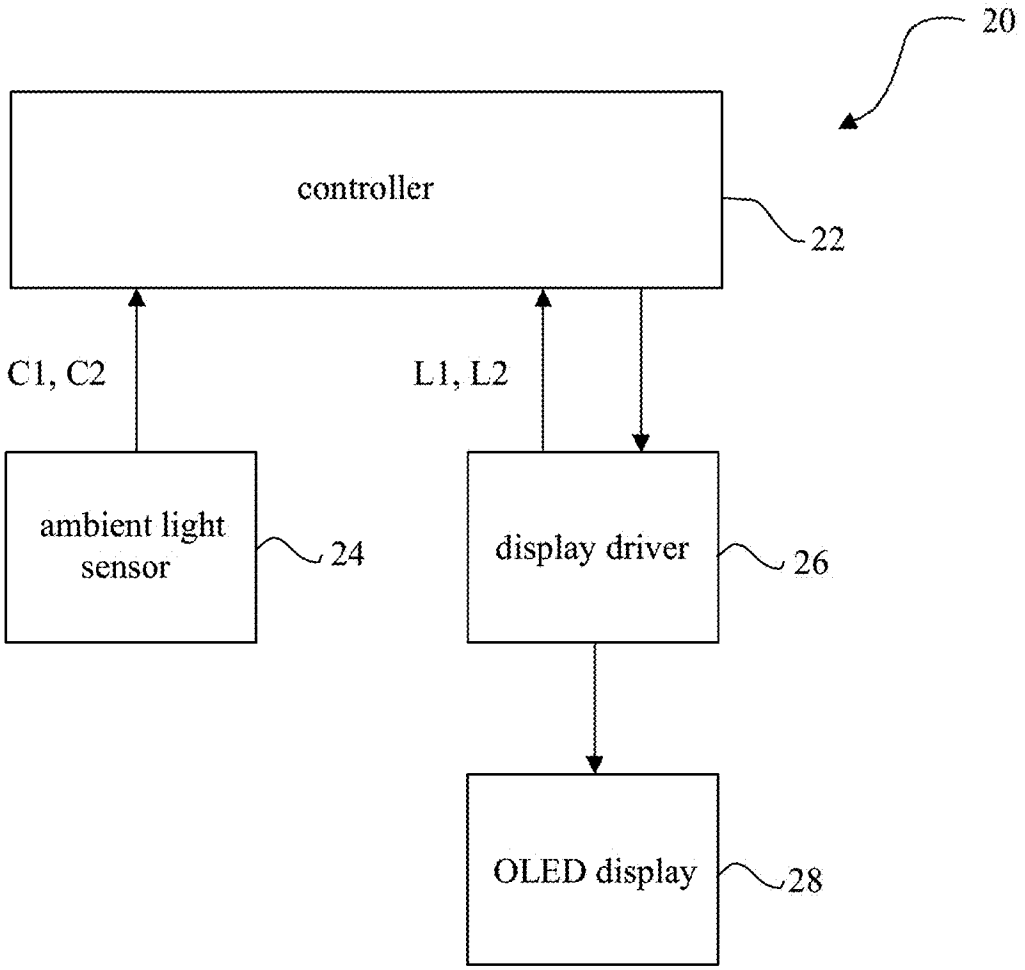
FIG. 3 shows a block diagram of an electronic device according to one embodiment of the present invention.
Figure 4:
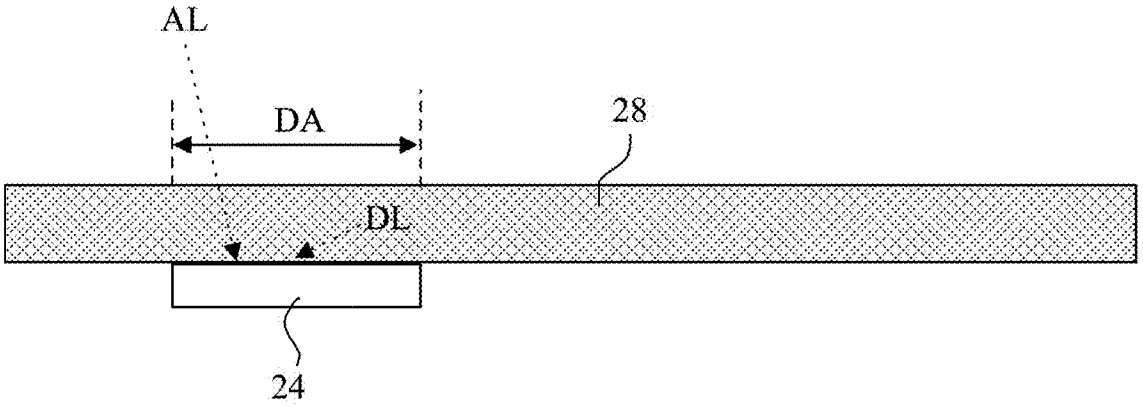
FIG. 4 is a sectional view schematically showing an ambient light sensor and an OLED display of an electronic device according to one embodiment of the present invention.

FIG. 3 shows a block diagram of an electronic device according to one embodiment of the present invention. The electronic device 20 in FIG. 3 comprises a controller 22, an ambient light sensor 24, a display driver 26 and an OLED display 28. FIG. 4 shows a sectional view of the ambient light sensor 24 and the OLED display 28 of the electronic device according to one embodiment of the present invention. As shown in FIG. 3 and FIG. 4, the OLED display 28 includes a first display area DA. The display driver 26 is coupled to the OLED display 28 and used to drive the OLED display 28. The ambient light sensor 24 is disposed under the first display area DA and used to sense light to obtain a sensing value. The controller 22 is coupled to the ambient light sensor 24 and the display driver 26. The controller 22 receives a first brightness coefficient L1 and a second brightness coefficient L2 from the display driver 26 and receives a first sensing value C1 and a second sensing value C2 from the ambient light sensor 24. The electronic device 20 of the present invention does not need a backlight module because the OLED display 28 is a self-luminescent display. Therefore, ambient light AL can easily pass through the OLED display 28 and can be sensed by the ambient light sensor 24 under the OLED display 28. The lights detected by the ambient light sensor 24 include the ambient light AL and the light DL emitted by the OLED display 28. Thus, the sensing value generated by the ambient light sensor 24 may be expressed by the following formula:

$$C = AL\,S + L \times \text{Color} \qquad \text{(Formula 1)}$$

wherein C is the sensing value generated by the ambient light sensor 24; ALS is the intensity of the ambient light AL; L is the brightness coefficient of the first display area DA; Color is the saturation of the first display area DA. According to Formula 1, in a period that the ambient light AL and the saturation Color of the first display area DA remain constant, while the brightness coefficient L of the first display area DA is a first brightness coefficient L1, the ambient light sensor 24 obtains a first sensing value:

$$C1=ALS+L1\times Color \quad \text{(Formula 2)}$$

while the brightness coefficient L of the first display area DA is a second brightness coefficient L2, the ambient light sensor 24 obtains a second sensing value:

$$C2=ALS+L2\times Color \quad \text{(Formula 3)}$$

According to the Formula 2 and Formula 3, the ambient light intensity ALS can be expressed as follows.

$$ALS=\frac{L2\times C1-L1\times C2}{L2-L1} \quad \text{(Formula 4)}$$

It is learned from Formula 4: in the case that the saturation Color of the first display area DA remains constant, after the ambient light sensor 24 generates the first sensing value C1 and the second sensing value C2, the first brightness coefficient L1, the second brightness coefficient L2, the first sensing value C1 and the second sensing value C2 may be used to correctly calculate the ambient light intensity ALS.

Figure 5:
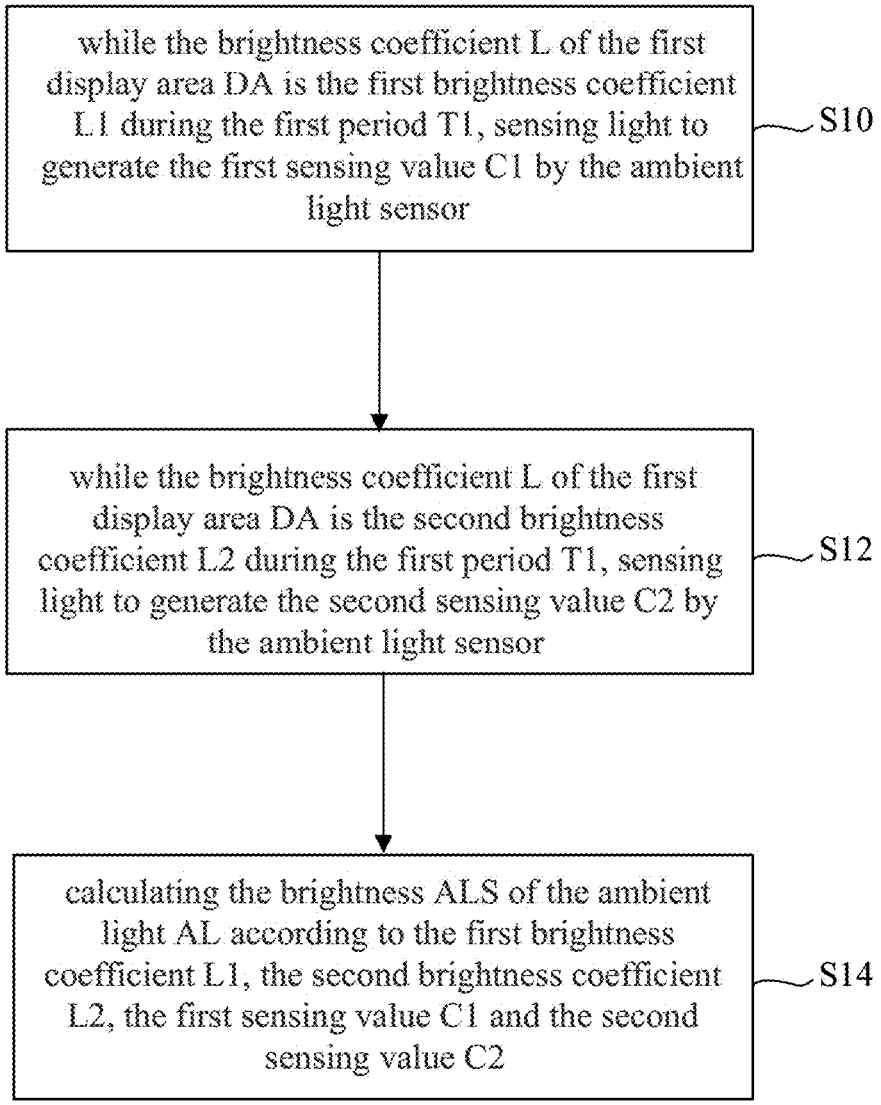
FIG. 5 is a flowchart of an ambient light sensing method of an electronic device according to one embodiment of the present invention.

In the electronic device 20 of the present invention, the saturation Color of the first display area DA of the OLED display 28 remains constant during a first period T1. In general, the saturation of the pixels of the OLED display 28 remains constant in a frame of the OLED display 28. Therefore, the first period T1 may be within the frame time of a frame. However, the first period T1 of the present invention is not limited within a frame. If the saturation of the first display area DA of the OLED display 28 remains constant during several frames, the first period T1 may be several frame time. The display driver 26 of the electronic device 20 changes the brightness coefficient of the first display area DA from the first brightness coefficient L1 to the second brightness coefficient L2 during the first period T1. While the brightness coefficient of the first display area DA is the first brightness coefficient L1 during the first period T1, the ambient light sensor 24 senses light to generate the first sensing value C1, as shown in step S10 of FIG. 5. While the brightness coefficient of the first display area DA is the second brightness coefficient L2 during the first period T1, the ambient light sensor 24 senses light to generate the second sensing value C2, as shown in step S12 of FIG. 5. The time interval between step S10 and step S12 is very short. Therefore, the ambient light intensity ALS in step S10 and step S12 may be regarded as the same. The time interval between step S10 and step S12 may be but is not limited to be 16 ms. The ambient light sensor 24 transmits the first sensing value C1 and the second sensing value C2 to the controller 22, and the display driver 26 provides the first brightness coefficient L1 and the second brightness coefficient L2 for controller 22. According to the first brightness coefficient L1, the second brightness coefficient L2, the first sensing value C1 and the second sensing value C2, the controller 22 executes the operation of Formula 4 to calculate the intensity ALS of the ambient light AL, as shown in step S14 of FIG. 5. The controller 22 may use a software or a hardware to execute the calculation of Formula 4. According to the calculated ambient light intensity ALS, the controller 22 generates a light regulation signal Sc to the display driver 26. According to the light regulation signal Sc, the display driver 26 regulates the brightness of the OLED display 28. In the present invention, the electronic device 20 may regulate the brightness of the OLED display 28 by a DC dimmingor a PWM dimming.

In one embodiment, the controller 22 and the ambient light sensor 24 are integrated in an integrated circuit.

In one embodiment, the software, which the controller 22 uses to execute the calculation of Formula 4, is incorporated into the operating system of the electronic device 20.

In one embodiment, the controller 22 provides the first brightness coefficient L1 and the second brightness coefficient L2 to the display driver 26.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. An electronic device, comprising:

an OLED display including a first display area, wherein a saturation of said first display area remains constant during a first period;

a display driver coupled to said OLED display, wherein said display driver changes a brightness coefficient of said first display area from a first brightness coefficient to a second brightness coefficient during said first period;

an ambient light sensor under said first display area and configured to sense light, wherein during said first period, said ambient light sensor senses light to generate a first sensing value while said brightness coefficient of said first display area is said first brightness coefficient and said ambient light sensor senses light to generate a second sensing value while said brightness coefficient of said first display area is said second brightness coefficient; and a controller configured to calculating an ambient light intensity according to said first brightness coefficient, said second brightness coefficient, said first sensing value and said second sensing value.

2. The electronic device according to claim 1, wherein said controller calculates said ambient light intensity according to a formula:

$$ALS=\frac{L2\times C1-L1\times C2}{L2-L1}$$

wherein ALS is said ambient light intensity; L1 is said first brightness coefficient; L2 is said second brightness coefficient; C1 is said first sensing value; C2 is said second sensing value.

3. The electronic device according to claim 2, wherein said controller executes calculation of said formula by a software or a hardware.

4. The electronic device according to claim 1, wherein said controller and said ambient light sensor are integrated in an integrated circuit.

5. The electronic device according to claim 1, wherein said first period is within a frame time of a frame of said OLED display.

6. An ambient light sensing method for an electronic device with an OLED display, said electronic device including an ambient light sensor under a first display area of said OLED display, said ambient light sensing method comprising the steps of:

A: sensing light to generate a first sensing value by said ambient light sensor when a brightness coefficient of said first display area is a first brightness coefficient in a first period;

B: sensing light to generate a second sensing value by said ambient light sensor when said brightness coefficient of said first display area is a second brightness coefficient in said first period;

C: calculating an ambient light intensity according to said first brightness coefficient, said second brightness coefficient, said first sensing value and said second sensing value;

wherein a saturation of said first display area remains constant in said first period.

7. The ambient light sensing method according to claim 6, wherein said step C comprises calculating said ambient light intensity according to a formula:

$$ALS = \frac{L2 \times C1 - L1 \times C2}{L2 - L1}$$

wherein ALS is said ambient light intensity; L1 is said first brightness coefficient; L2 is said second brightness coefficient; C1 is said first sensing value; C2 is said second sensing value.

8. The ambient light sensing method according to claim 7, wherein said step C comprises executing calculation of said formula by a software or a hardware.

9. The ambient light sensing method according to claim 7, wherein said step C comprising executing calculation of said formula by said ambient light sensor.

10. The ambient light sensing method according to claim 6, wherein said first period is within a frame time of a frame of said OLED display.

* * * * *